US009559432B2

(12) United States Patent
Sun et al.

(10) Patent No.: US 9,559,432 B2
(45) Date of Patent: Jan. 31, 2017

(54) ANTENNA CONTROL SYSTEM AND MULTI-FREQUENCY SHARED ANTENNA

(71) Applicant: Comba Telecom System (China) Ltd., Guangzhou, Guangdong Province (CN)

(72) Inventors: Shan qiu Sun, Gaungzhou (CN); Feifei Jia, Gaungzhou (CN); Peitao Liu, Guangzhou (CN)

(73) Assignee: COMBA TELECOM SYSTEM (CHINA) LTD., Guangzhou, Guangdong Province (CN)

( * ) Notice: Subject to any disclaimer, the term of this patent is extended or adjusted under 35 U.S.C. 154(b) by 236 days.

(21) Appl. No.: 14/371,369

(22) PCT Filed: Dec. 28, 2012

(86) PCT No.: PCT/CN2012/087783
§ 371 (c)(1),
(2) Date: Jul. 9, 2014

(87) PCT Pub. No.: WO2013/104260
PCT Pub. Date: Jul. 18, 2013

(65) Prior Publication Data

US 2015/0009078 A1 Jan. 8, 2015

(30) Foreign Application Priority Data

Jan. 13, 2012 (CN) ..... 2012 1 0012047

(51) Int. Cl.

| | |
|---|---|
| ***H01Q 21/26*** | (2006.01) |
| ***H01Q 5/307*** | (2015.01) |
| ***H01Q 21/24*** | (2006.01) |
| ***H01Q 21/06*** | (2006.01) |
| ***H01Q 19/10*** | (2006.01) |

(Continued)

(52) U.S. Cl.
CPC ..... *H01Q 21/26* (2013.01); *H01Q 5/307* (2015.01); *H01Q 5/42* (2015.01); *H01Q 19/108* (2013.01); *H01Q 21/0006* (2013.01); *H01Q 21/06* (2013.01); *H01Q 21/24* (2013.01)

(58) Field of Classification Search
CPC ..... H01Q 21/26
USPC ..... 343/727
See application file for complete search history.

(56) References Cited

U.S. PATENT DOCUMENTS

| | | | | |
|---|---|---|---|---|
| 7,692,601 | B2 * | 4/2010 | Bisiules | H01P 5/103 343/797 |
| 2004/0155831 | A1 * | 8/2004 | Goebel | H01Q 1/1207 343/775 |
| 2010/0309084 | A1 * | 12/2010 | Bu | H01Q 21/08 343/824 |

* cited by examiner

*Primary Examiner* — Dameon E Levi
*Assistant Examiner* — Walter Davis
(74) *Attorney, Agent, or Firm* — John W. Powell

(57) ABSTRACT

A multi-frequency shared antenna comprises a low frequency radiation array and a first high frequency radiation array both of which are disposed on a reflection plate and provided with power by different feeding networks. The first high frequency radiation array comprises a number of high frequency radiation units, at least partial high frequency radiation units are arranged on a same axis which overlaps one of two axes of the low frequency radiation array, in all high frequency radiation units arranged on said axis, at least partial high frequency radiation units are nested with the low frequency radiation units arranged on the same axis, and the orthogonal projection area of these nested high frequency radiation units on the reflection plate falls within the orthogonal projection area of the corresponding low frequency radiation units on the same reflection plate.

17 Claims, 8 Drawing Sheets

(51) Int. Cl.
*H01Q 21/00* (2006.01)
*H01Q 5/42* (2015.01)

ANTENNA CONTROL SYSTEM AND MULTI-FREQUENCY SHARED ANTENNA

RELATED APPLICATIONS

This application is a U.S. National Stage of international application number PCT/CN2012/087783 filed Dec. 28, 2012, which claims the benefit of the priority date of Chinese Patent Application CN 201210012047.0, filed on Jan. 13, 2012, the contents of which are herein incorporated by reference.

FIELD OF THE INVENTION

The present invention relates to field of mobile communication antenna and more particularly, relates to a multi-frequency shared antenna and antenna control system based on said multi-frequency shared antenna.

BACKGROUND OF THE INVENTION

With increase of mobile communication network standards, to save sites and location, reduce difficulty of estate management coordination, and decrease investment cost, multi-frequency shared antenna sharing a common site and location is eventually becoming a first choice for operators in networking business.

Currently in this industry, two constructions are mainly employed to multi-frequency shared antennae array. One solution is coaxial nesting as denoted in FIG. 1. According to this solution, a low frequency radiation unit 1*a* and a high frequency radiation unit 2*a* are coaxially arranged on a same axis 4*a* of a reflection plate 3*a*. Another solution is side by side adjoining solution as shown in FIG. 2. In this solution, a low frequency radiation unit 1*b* and a high frequency radiation unit 2*a* are separately disposed on two adjacent axes 4*b* and 5*b* of a reflection plate 3*b*. Needless to say, the axial nesting scheme significantly has smaller antenna width and windward area than side by side scheme and accordingly, it gets much favor from clients.

It has been found in practice that coaxial nesting technique shown in FIG. 1 suffers from certain limit during use and there are at least two drawbacks.

At first, in case that pitch between low frequency radiation units 1*a* arranged in line with the high frequency radiation units 2*a* is not integer times of pitch between high frequency radiation units 2*a*, in an orthogonal projection area formed by orthogonally projecting onto the reflection plate, radiation arms of the low frequency radiation unit 1*a*, which is enable to nest with the high frequency radiation unit 2*a*, will be over the high frequency radiation unit 2*a* and overlap and cross with the same (as shown in FIG. 3, the low frequency radiation unit 1*c* crosses and overlaps with the high frequency radiation unit 2*c*), thus causing severe interference to high frequency radiation array formed by said high frequency radiation unit 2*a*, and greatly increasing difficulty in design of high frequency radiation array radiation characteristics. For example, when coaxial nesting technique applies to multi-frequency shared electrically adjustable antenna working at frequency of 790~960 MHz and 1710~2690 MHz, to make balance between gain and parameters such as electrically down-tilted upper side-lobes, pitch range of low frequency radiation array is normally from 250 mm to 300 mm, while pith range of high frequency radiation array is normally from 105 mm to 115 mm. No matter what sort of array pitch is selected from above ranges for high and low frequency, when all the high frequency radiation units 2*b* and low frequency radiation units 1*b* are coaxial, radiation arms of some low frequency radiation units 1*b* will locate over the high frequency radiation units 2*b*, thereby causing severe interference to high frequency radiation units 2*b*, and greatly increasing difficulty in design of high frequency radiation array radiation characteristics. Attempts have been made to overcome this problem by reducing projection area of the low frequency radiation units 1*b*. However, this will also increase half-power beam width in horizontal plane of the low frequency radiation units 1*b* and therefore no desired results may be obtained.

Secondly, it may be applied into triple electrically adjustable antenna constructed of a low frequency radiation array and two identical high frequency radiation arrays. Regarding this point, there are two prior art solutions. One is shown in FIG. 4 where a group of high frequency radiation arrays is added to an antenna along a vertical direction. The shortcoming of this solution lies in substantial increase in antenna length. Further, transmission loss as well as antenna gain loss is increased due to lengthening of main feeder line of upper high frequency radiation array. A second solution is illustrated in FIG. 5 where a group of high frequency radiation arrays is added to an antenna at a lateral side thereof. This solution suffers from shortcoming such as substantial increase of antenna width. In addition, all the low frequency radiation arrays are distributed at a side of the high frequency radiation arrays. Due to dramatic asymmetry between left and right radiation boundary of the low and high frequency radiation arrays together with cross-interference between the two arrays, problem such as direction deflection of horizontal plane beam of the two arrays and cross polarization ratio deterioration arises. This results in increased difficulty in design.

SUMMARY OF THE INVENTION

One object of the invention is to provide a multi-frequency shared antenna capable of maintaining reasonable antenna size and good electric characteristics.

Another object of the invention is to provide an antenna control system for more suitably using the multi-frequency shared antenna in field.

To achieve above objects, there is provided a technical solution as follows.

A multi-frequency shared antenna according to the invention comprises a low frequency radiation array and a first high frequency radiation array both of which are disposed on a reflection plate and provided with power by different feeding networks, wherein, the low frequency radiation array comprises a number of low frequency radiation units axially arranged on at least two parallel axes, and said low frequency radiation units on said two axes are misaligned along a direction orthogonal to these axes;

the pitch between said two axes of the low frequency radiation array is smaller than or equal to half wavelength of the low frequency radiation array at its highest working frequency point, and it is also greater than or equal to half wavelength of the high frequency radiation array at its highest working frequency point;

each low frequency radiation unit comprises two pairs of symmetrical dipoles arranged such that their polarization is orthogonal to each other, and two symmetrical dipoles of one pair of symmetrical dipoles of at least one low frequency radiation unit of the low frequency radiation array have different feed-in power setting;

the first high frequency radiation array comprises a number of high frequency radiation units, at least partial high frequency radiation units are arranged on a same axis which overlaps one of two axes of the low frequency radiation array, in all high frequency radiation units arranged on said axis, at least partial high frequency radiation units are nested with the low frequency radiation units arranged on the same axis, and the orthogonal projection area of these nested high frequency radiation units on the reflection plate falls within the orthogonal projection area of the corresponding low frequency radiation units on the same reflection plate.

According to one embodiment of the invention, for the two axes on which the low frequency radiation array locates, any two adjacent low frequency radiation units arranged on different axes form a group, in four symmetrical dipoles with the same polarization of the group, a symmetrical axis is defined between a first axis and a second axis, symmetrical dipoles close to said symmetrical axis have the same or substantially same feed-in power, symmetrical dipoles away from said symmetrical axis have the same or substantially same feed-in power, and the feed-in power of the dipoles close to the symmetrical axis is greater than that of the dipoles away from the symmetrical axis.

According to another embodiment of the invention, a symmetrical axis is defined between a first and second axes of two axes occupied by the low frequency radiation array, the sum of feed-in power of the adjacent symmetrical dipoles located at left of the symmetrical axis is identical to or substantially identical to that of the adjacent symmetrical dipoles located at right of the symmetrical axis, the sum of feed-in power of the symmetrical dipoles located at left of the symmetrical axis and distanced away from each other is identical to or substantially identical to that of the symmetrical dipoles located at right of the symmetrical axis and distanced away from each other, and the sum of the former is larger than that of the latter.

According to another embodiment of the invention, the antenna further comprises a second high frequency radiation array powered by other feeding network, the second high frequency radiation array comprises a number of high frequency radiation units which are at least partially arranged on a same axis, and the axis of the first high frequency radiation array is adjacent and parallel to that of the second high frequency radiation array.

According to another embodiment of the invention, the axis of the second high frequency radiation array overlaps one axis of the low frequency radiation array, at least partial high frequency radiation units of the second high frequency radiation array are nested with the low frequency radiation units arranged on the same axis, and the orthogonal projection area of these nested high frequency radiation units on the reflection plate falls within the orthogonal projection area of corresponding low frequency radiation units on the same plate.

According to another embodiment of the invention, at one end of the symmetrical axis of the axes of the first and second high frequency radiation arrays, the plural low frequency radiation units of the low frequency radiation array are distributed along said symmetrical axis.

According to another embodiment of the invention, the antenna further comprises a third and fourth high frequency radiation arrays located parallel to each other and powered by separate feeding networks, an axis of the third high frequency radiation array overlaps an extension line of the axis of the first high frequency radiation array, and an axis of the fourth high frequency radiation array overlaps an extension line of the axis of the second high frequency radiation array, in the ranges of the extension lines where the third and fourth high frequency radiation arrays located, there are low frequency radiation units for nesting with the third and fourth high frequency radiation arrays, the orthogonal projection area of these nested high frequency radiation units on the reflection plate falls within the orthogonal projection area of corresponding low frequency radiation units on the same plate.

According to another embodiment of the invention, the antenna further comprises a third and fourth high frequency radiation arrays parallel to the first and second high frequency radiation arrays respectively and powered by separate feeding networks, and a second low frequency radiation array powered by separate feeding network, the second low frequency radiation array is assembled with the third and fourth high frequency radiation arrays by the manner aforementioned, and an axis thus formed is parallel to the aforementioned axes.

According to another embodiment of the invention, part of the high frequency radiation units of the first high frequency radiation array are arranged along another axis; and the high frequency radiation units of the first high frequency radiation array arranged on respective axes are misaligned among each other along a direction orthogonal to the axes.

According to another embodiment of the invention, both the low frequency radiation array and first high frequency radiation array are distributed on two axes, one axis of the low frequency radiation array overlaps one axis of the first high frequency radiation array, and another axis of the low frequency radiation array and another axis of the first high frequency radiation array are symmetrical about the overlapped axis.

Preferably, there is no interference between an orthogonal projection on the reflection plate of a radiation arm of a symmetrical dipole of any low frequency radiation unit and that of a symmetrical dipole of any high frequency radiation unit.

Preferably, along an orthogonal projecting direction towards the reflection plate, the pitch between two adjacent axes of the low frequency radiation array is smaller than or equal to the biggest orthogonal projection size of an individual low frequency radiation unit arranged on these axes.

Preferably, along the axial direction of the low frequency radiation array, some low frequency radiation units with odd locations are arranged on an axis of the low frequency radiation array, while some low frequency radiation units with even locations are arranged on another axis thereof.

Preferably, along the axial direction of the low frequency radiation array, some low frequency radiation units with discrete locations are arranged on an axis of the low frequency radiation array, while some low frequency radiation units with continuous locations are arranged on another axis thereof.

Specifically, the high frequency radiation units and/or low frequency radiation units are of printed planar radiation unit or surface mounted dipole. The biggest diameter of the low frequency radiation unit is smaller than 150 mm.

An antenna control system according to a second object of the invention comprises a multi-frequency shared antenna as described above, and further comprises a phase shifter for changing phase of signal provided to the radiation units inside the antenna, the phase shifter comprises first and second components, and sliding of the first component relative to the second component results in phase change of signal passing through the phase shifter.

To realize electrical adjustment per requirement, the system comprises an electromechanical driving component; the electromechanical driving component comprises a power control unit, a motor and a mechanical driving unit; in response to an external control signal, the power control unit drives the motor to produce a predefined motion; and through the torque generated by the mechanical driving unit, the predefined motion of the motor is applied to the first component so as to realize phase shifting.

Compared to prior art, the present invention has the following good technical advantages.

Compared to coaxial nesting technical solution in which low frequency radiation array and high frequency radiation array are arranged coaxially, in present invention, the low frequency radiation array is divided into two or more groups distributed on different axis. Each group comprises one or more low frequency radiation units. One group is disposed to overlap the axis of the high frequency radiation array.

In case that pitch among low frequency radiation units arranged on the same axis is not integer times as great as that of the high frequency radiation units, interference (overlapping or crossing) between radiation arms of the low frequency radiation array and that of the high frequency radiation array in the orthogonal projection area in the reflection plate is avoided, as would have occur in above coaxial nesting technical solution, thus low and high frequency radiation arrays design difficulty is also reduced.

In the context of treble frequency shared antenna including a low frequency radiation array and two high frequency radiation arrays both having the same frequency, at least part of the high frequency radiation units of the two high frequency radiation arrays are arranged on two substantially parallel axes, and they overlap with one axis of the low frequency radiation array respectively. In addition, at least partial high frequency radiation units on each axis are nested with the low frequency radiation units on the same axis. This eliminates gain loss and size increase of the entire antenna due to direct addition of a high frequency radiation array along a vertical direction of the antenna as would be in above coaxial nesting solution.

Compared to another solution in which the low frequency radiation array and high frequency radiation array re adjoined together, the low frequency radiation array is divided into two or more groups distributed on different axis. Each group comprises one or more low frequency radiation units. One group is disposed to overlap the axis of the high frequency radiation array. The number of the low frequency radiation units at one side of the high frequency radiation array is reduced. At the same time, the number of the high frequency radiation units at one side of the low frequency radiation array is also reduced. Left and right asymmetry of the low and high frequency radiation arrays is also improved. Correspondingly, horizontal plane beam direction deflection and cross-polarization ratio are also improved, this further reducing design difficulty.

Furthermore, in a range smaller than or equal to half wavelength of the low frequency radiation array at its highest working frequency point and also larger than or equal to half wavelength of the high frequency radiation array at its highest working frequency point, the pitch between at least two axes of the low frequency radiation array is regulated. This brings better radiation characteristics such as horizontal plane half power beam width of the multiple-frequency shared antenna. Additionally, the entire lateral size (along orthogonal direction) is just smaller than the lateral size of the low frequency radiation array adjoined the high frequency radiation array, but larger than the lateral size when the low frequency radiation array and high frequency radiation array are nested together.

Moreover, by adjusting signal feed-in power of two symmetrical dipoles of each polarization of the low frequency radiation unit and setting radiation diameter of the low frequency radiation units, desired horizontal plane half power beam width absolute value is obtained for the low frequency radiation array. Further, better horizontal plane half power beam width convergence is also obtained. For example, in frequency range of 790-960 MHz, horizontal plane half power beam width is within 62±3 degree. This can't be realized when the low frequency radiation array and high frequency radiation array are nested together or when the low frequency radiation array and high frequency radiation array are adjoined together.

By adjusting power of two symmetrical dipoles of each polarization of the low frequency radiation unit, vertical plane half power beam width of the low frequency radiation array is extended. In addition, due to better horizontal plane half power beam width convergence, the smallest gain of the low frequency radiation array working frequency band is still superior than prior art nesting solution and adjoining solution.

Evidently, the present invention is able to realize sharing of multiple frequencies antenna in as small as possible size. The pitch between radiation units no longer results in interference between the low and high frequency beams. The antenna control system based on this multiple-frequency shared antenna thus also bears all advantages described above. This multiple-frequency shared antenna will make it easy and convenient to locate and trim low frequency radiation unit during design period.

DETAILED DESCRIPTION OF THE INVENTION

The present invention is described in further detail in conjunction with various embodiments and accompanied drawings.

It is well known that a radiation array (including low frequency and high frequency radiation array) is intended to transmit communication signals and is generally constituted by a plurality of radiation units arranged in matrix in the form of a single or multiple lines. As to high frequency signals, a high frequency radiation array is formed by plural high frequency radiation units. Correspondingly, a low frequency radiation array is formed by plural low frequency radiation units. Here, in a radiation unit, a component for transmitting and receiving signals is a symmetrical dipole of the unit. An electrical component of the symmetrical dipole is its radiation arm which is supported by a balun of the symmetrical dipole. In a radiation unit, to improve gain of polarization diversity receiving, two pairs of symmetrical dipoles are employed and they are arranged such that their polarization is orthogonal to each other. Two symmetrical dipoles of each pair of symmetrical dipoles may have different feed-in power setting. The radiation unit may be planar and printed on a plate, or it may also be of a three-dimensional construction. These fundamental concepts will be referenced throughout all description of various embodiments of the invention. When the radiation array is installed on a reflection plate, an orthogonal projection area is formed when the array is projected toward the reflection plate. FIGS. 6-13 of the invention will be illustrated with reference to this orthogonal projection area to clearly show relation along different radiation arrays.

Figure 6:
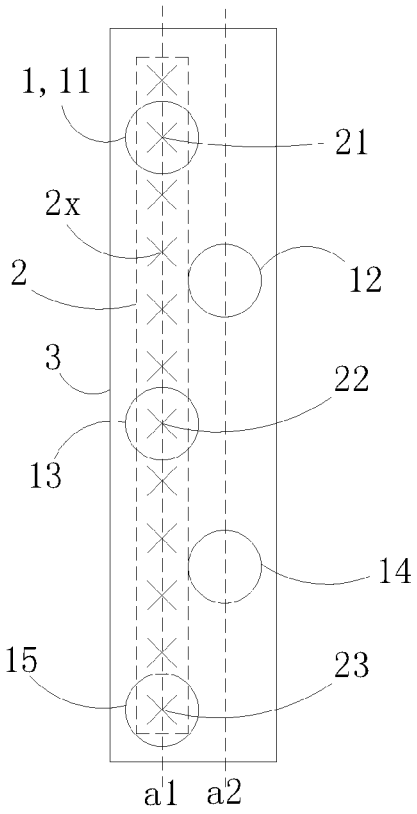
FIG. 6 shows a structural view of a first embodiment of a multi-frequency shared antenna according to the invention which is suitable to be used in application where signals of two frequencies are transmitted.

Please refer to FIG. 6. According to a first embodiment of the present invention, a multi-frequency shared antenna has a reflection plate 3 onto which a low frequency radiation array 1 and a high frequency radiation array 2 are arranged.

The low frequency radiation array 1 is composed of 5 low frequency radiation units 11-15. In these low frequency radiation units 11-15, from top to bottom, 3 low frequency radiation units 11, 13 and 15 (all have odd reference numerals) are located on a first axis a1, while 2 low frequency radiation units 12 and 14 (all have even reference numerals) are located on a second axis a2. The first and second axes a1 and a2 are parallel with each other. In addition, in a direction orthogonal to the two adjacent axes a1 and a2 (that is, horizontal direction in this figure and this also applies hereinafter), the low frequency radiation units 11-15 located on these axes a1 and a2 respectively are distributed alternately. In other words, along the orthogonal direction of the axes a1 and a2, none of the low frequency radiation units on the axis a1 will be in side by side relation with any one of the low frequency radiation units on the axis a2. Along a projection direction orthogonal to the reflection plate 3 (that is, a direction perpendicular to and facing paper sheet, and the same is true for followed description), the distance between the first axis a1 and second axis a2 is smaller than or equal to the largest orthogonal projection size of an individual low frequency radiation unit located on these axes a1 and a2. By this way, it is ensured that the horizontal dimension of the entire antenna is smaller than that when the low frequency radiation array 1 and high frequency radiation array 2 are adjoined to each other, though larger than that when the low frequency radiation array 1 and high frequency radiation array 2 are nested with each other. On the other hand, the pitch between the first axis a1 and second axis a2 may be configured to be less than or equal to half wavelength of the low frequency radiation array at its highest working frequency point, and at the same time, larger than or equal to half wavelength of the high frequency radiation array at its highest frequency point, thus obtaining balance between antenna size and best electric performance. Normally, if the two axes a1 and a2 meet the former pitch setting, they will also meet the latter pitch setting.

The high frequency radiation array 2 is composed of 12 high frequency radiation units 2*x* all of which are disposed at the same axis a1. Of course, this axis a1 is also the first axis a1 of the low frequency radiation array 1.

Apparently, for high frequency radiation units 2*x* and low frequency radiation units 11-15, if they are arranged linearly, then the pitch between two adjacent low frequency radiation units is not equal to that between two adjacent high frequency radiation units. However, it is also required that the pitch between two adjacent high frequency radiation units 2*x* is constant and the same applies to the two adjacent low frequency radiation units 11-15. In this situation, 3 low frequency radiation units 11, 13 and 15 distributed on odd locations and all high frequency radiation units 12, 14 are arranged commonly on the first axis a1. By this manner, the pitch between two adjacent high frequency radiation units 2*x* arranged on the first axis a1 is a constant value, and pitch between two adjacent low frequency radiation units 11, 13 and 15 is necessarily integer times of the above constant value. Assume that pitch between two adjacent low frequency radiation units 11 and 13 or 13 and 15 arranged on the first axis a1 is 5 times as great as that between two adjacent high frequency radiation units. Under this assumption, each of 3 low frequency radiation units 11, 13 and 15 may be concentrically nested with a corresponding one of 3 high frequency radiation units 21, 22 and 23. Regarding two low frequency radiation units 12 and 14 arranged at even locations, pitches among them are equal to those of low frequency radiation units 11, 13 and 15 located on the first axis a1. In addition, the two axes a1 and a2 of the low frequency radiation array 1 may be set to overlap with each other. It can be found that in overlapped low frequency radiation array 1, all low frequency radiation units 11-15 are located with equal pitch. In other words, for these low frequency radiation units 11-15 positioned at different axes a1 and a2, they have definite and same pitch.

Preferably, on an orthogonal projection area formed on the reflection plate 3, all these nested high frequency radiation units 2*x* and low frequency radiation units 11-15 are located with their geometrical centers coincide among each other. For example, in FIG. 6, centers of the low frequency radiation units 11, 13 and 15 overlap corresponding centers of high frequency radiation units 21, 22 and 23 and therefore, orthogonal projection area of the radiation arm of each high frequency radiation unit falls within the range of orthogonal projection area of the radiation arm of a corresponding low frequency radiation unit nested with said high frequency radiation unit. In addition, these orthogonal projection areas neither overlap nor cross among each other. The diameter of low frequency radiation unit is normally large. In present invention, it is designed to be less than or equal to 150 mm so as to get optimum setting. Accordingly, person of ordinary skill in the art will know that this kind of nesting design may be extended such that orthogonal projection area of the high frequency radiation unit on the reflection plate falls within the orthogonal projection area of the low frequency radiation unit on the reflection plate.

Each of the low frequency radiation units 11, 13 and 15 on the first axis a1 is nested with a corresponding one of the high frequency radiation units 21, 22 and 23. Each of the low frequency radiation units 12 and 14 on the second axis a2 is adjacent to all the high frequency radiation units 2*x*. Therefore, on the orthogonal projection area of the reflection plate 3, it is avoided that radiation arms (not shown in details, see circles) of the symmetrical dipole of the low frequency radiation units 11-15 will be interfered with radiation arms (not shown in details, see cross line) of the symmetrical dipole of the one or two high frequency radiation units (interfering means overlapping or crossing of the images formed on the orthogonal projection area). Therefore, signal interference between the low frequency radiation array 1 and high frequency radiation array 2 is reduced mostly, ensuring that signal transmission and receiving of the low frequency radiation array 1 and high frequency radiation array 2 is independent of each other.

Each low frequency radiation unit includes two pairs of symmetrical dipoles all of which are circularly arranged and symmetrical about a center. As described above, the low frequency radiation array constructed by said low frequency radiation units 11-15 is located on the first and second axes a1 and a2 respectively. Take a symmetrical axis between the first axis a1 and second axis a2 as a reference line. Each of low frequency radiation units 11, 13 and 13 on the first axis a1 has a symmetrical dipole positioned towards the reference line and second axis a2. Another symmetrical dipole is positioned away from the reference line and second axis a2. By the same token, each of low frequency radiation units 12 and 14 on the second axis a2 has a symmetrical dipole positioned towards the reference line and first axis a1. Another symmetrical dipole is positioned away from the reference line and first axis a1. Consequently, symmetrical dipoles located inside of the two axes a1 and a2 are adjacent among each other, while those located outside of the two axes a1 and a2 are distanced among each other. For the low frequency radiation array located on said axes a1 and a2, the symmetrical dipoles adjacently located have same or substantially same signal feed-in power, and the symmetrical dipoles located outside of the axes also have same or substantially same signal feed-in power. In addition, the feed-in power of the former is larger than the latter. By this manner, extension of horizontal plane beam of low frequency radiation array is achieved.

Another way of extending horizontal plane beam is described below. Based on above reference line, adjacent symmetrical dipoles located at one side of the reference line and close to the line has a total feed-in power same or substantially same as that of the adjacent symmetrical dipoles located at the other side of the reference line and close to the same line. Similarly, symmetrical dipoles located at one side of the reference line and away from the line has a total feed-in power same or substantially same as that of the symmetrical dipoles located at the other side of the reference line and also away from the same line. This ensures that the sum of feed-in power of the former is larger than that of the latter.

Preferably, the term "substantially same" means symmetrical dipoles located at two adjacent axes have same signal feed-in power. However, it is noted that physical error is unavoidable. As such, person of ordinary skill in the art will understand that the term "substantially same" also permits adjacent symmetrical dipoles located at two axes have infinitely approximated signal feed-in power. Said means for extending horizontal half power beam width of low frequency radiation array also applies to other embodiments of the invention.

It is clear that during design phase, it is very important to arrange location of the low frequency radiation units 11-15 of the low frequency radiation array 1. In present invention, arrangement is achieved by following manner. At first, according to axes a1 and a2, the low frequency radiation units 11-15 of the low frequency radiation array 1 are arranged to form a temporary array. Next, adjust size and/or boundary condition of an orthogonal projection area formed by projecting the low frequency radiation unit of each temporary array, so that the horizontal plane half power beam width of the temporary array is larger than a given value. Then, increase or decrease axis pitch between two adjacent temporary arrays such that horizontal plane half power beam width of the entire low frequency radiation array 1 is correspondingly increased or reduced until it is close or equal to said given value. After the preceding step is met, the current antenna layout is fixed.

In this embodiment, the high frequency radiation array 2 is equipped with a feeding network (not shown) for supplying power to respective high frequency radiation unit 2*x* located on the first axis a1 such that the high frequency radiation array 2 is able to radiate high frequency signals. Also, the low frequency radiation array 1 is equipped with another feeding network for supplying power to respective low frequency radiation units 11-15 located on the first and second axes a1 and a2 such that the low frequency radiation array 1 is able to radiate low frequency signals. By this manner, a dual-frequency shared antenna is thus formed. This antenna has reasonable size, and better electric performance. Pitch between two adjacent low frequency radiation units of the 3 units 11, 13 and 15 of the low frequency radiation units 11-15 is always integer times as great as that between two adjacent high frequency radiation units 2*x*. Therefore, signal interference among them is mostly reduced.

Figure 7:
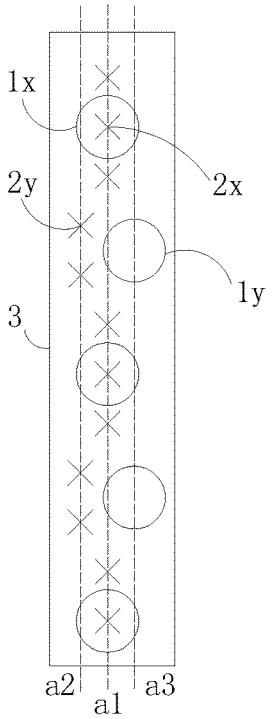
FIG. 7 shows a structural view of a second embodiment of a multi-frequency shared antenna according to the invention which is suitable to be used in application where signals of two frequencies are transmitted.

Please refer to FIG. 7 illustrating a second embodiment of the multiple-frequency shared antenna of the invention. In this embodiment, it is a dual-frequency shared antenna and the difference of it from the first embodiment lines in 12 high frequency radiation units 2*x* of the high frequency radiation array 2 are designed to be distributed along two axes a2 and a3.

More specifically, as depicted in FIG. 7, there are 3 axes a1, a2 and a3. Here, the first axis a1 is shared by partial low frequency radiation units 1*x* and partial high frequency radiation units 2*x*; the rest high frequency radiation units 2*y* are separately disposed on the second axis a2; while the rest low frequency radiation units 1*y* are separately disposed on the third axis a3. The second axis a2 and third axis a3 are symmetrical about the first axis a1.

Similar to the first embodiment, along axial direction of the axes a1, a2 and a3, the high frequency radiation units 2*x* and 2$y$ have identical axial pitch, and the low frequency radiation units 1$x$ and 1$y$ also have identical axial pitch. In this embodiment however, two high frequency radiation units 2$y$ corresponding along an orthogonal direction to each low frequency radiation unit 1$x$ (there are 2 units 1$x$ and accordingly there are 4 units 2$y$) arranged on the third axis a3 are biased away from the first axis a1 and disposed on the second axis a2, thus forming layout as shown in FIG. 7.

The improvement of this embodiment has effect similar to the first embodiment. However, this embodiment achieves more even and symmetrical physical construction. Compared to the first one, this embodiment further reduces horizontal size. In all embodiments of the invention, the low and high frequency radiation units work on different frequency range. Here, "low frequency" as occurred in low frequency radiation unit is relative to the "high frequency" as used in high frequency radiation unit. Preferably, the low frequency radiation units work on frequency range of 790-960 MHz covering 2G and 3G mobile communication frequency bands currently used all over the world, while high frequency radiation units work on frequency range of 1700-2700 MHz covering 4 G mobile communication frequency band such as LTE currently used all over the world.

Figure 8:
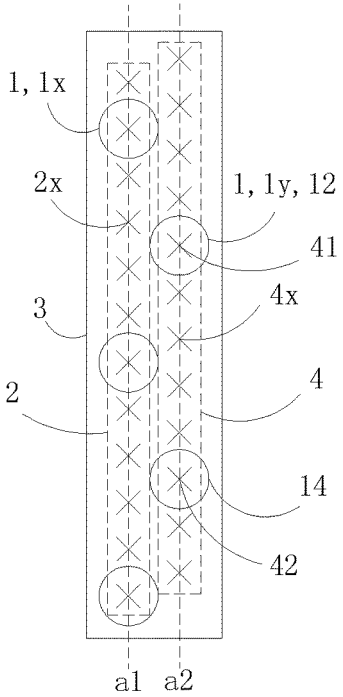
FIG. 8 shows a structural view of a third embodiment of a multi-frequency shared antenna according to the invention which is suitable to be used in application where signals of two or three frequencies are transmitted.

Referring to FIG. 8 and according to a third embodiment of the multi-frequency shared antenna of the invention, a treble-frequency shared antenna is disclosed. Apparently, compared to the first high frequency radiation array 2 and low frequency radiation array 1 described in the first embodiment, in this embodiment, a second high frequency radiation array 4 is added. In addition, the second high frequency radiation array 4 is provided with power by another feeding network different from the first high frequency radiation array 2. The second high frequency radiation array 4 also includes 12 high frequency radiation units 4$x$ arranged along a same axis. From FIG. 8 it can be seen that the axis a2 of the second high frequency radiation array 4 is parallel to the axis a1 of the first high frequency radiation array 2 and overlaps with the second axis a2 of the first low frequency radiation array 1. Thus, the second high frequency radiation array 4 is parallel to the first high frequency radiation array 2. To obtain nesting between the low frequency radiation unit 1$y$ of the low frequency radiation array 1 arranged on the second axis a2 and high frequency radiation unit 2$y$ of the high frequency radiation unit 2$y$ arranged on the same axis a2, start location of the second high frequency radiation array 4 on the second axis a2 is adjusted so that the orthogonal projection of the two high frequency radiation units 41, 42 on the reflection plane 3 and that of the two low frequency radiation units 12, 14 of the low frequency radiation array 1 on the second axis a2 have the same geometrical center (nesting relationship as described in the first embodiment). For the multi-frequency shared antenna thus formed, the first high frequency radiation array 2 and second high frequency radiation array 4 will be misaligned in vertical direction. This layout will not have influence on its electric performance. Therefore, this embodiment is also able to realize normal signal operation at 3 frequency bands. This ensures that antenna size is minimized and also ensures that interference among radiation arrays working different frequency bands is mostly reduced.

Figure 1:
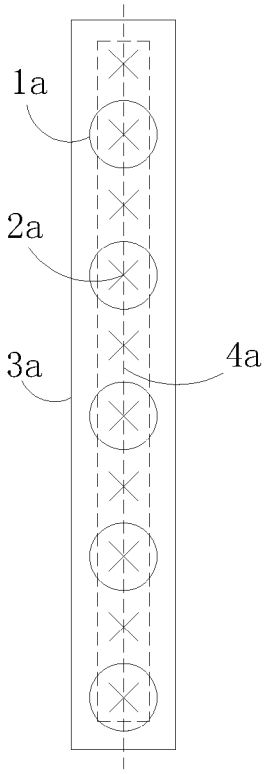
FIG. 1 shows a prior art structural view of a dual-frequency shared antenna employing coaxial nesting technique.
Figure 2:
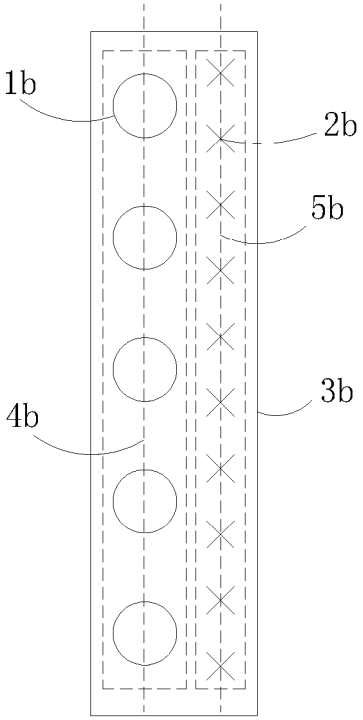
FIG. 2 shows a prior art structural view of a dual-frequency shared antenna employing adjoining technique.
Figure 3:
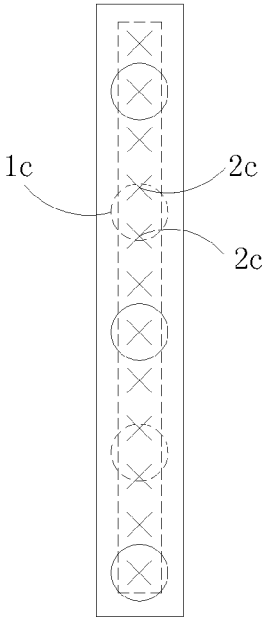
FIG. 3 shows a prior art structural view of a dual-frequency shared antenna employing coaxial nesting technique in which radiation arms of low frequency radiation units locate above high frequency radiation units, thus resulting in overlapping between dipole arms in an orthogonal projection area generated by orthogonally projecting onto a reflection plate.
Figure 4:
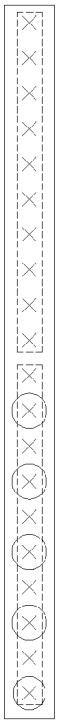
FIG. 4 shows a prior art structural view of a triple frequency shared antenna.
Figure 5:
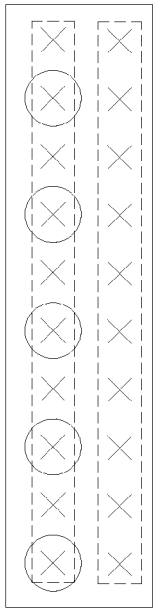
FIG. 5 shows another prior art structural view of a triple frequency shared antenna.
Figure 9:
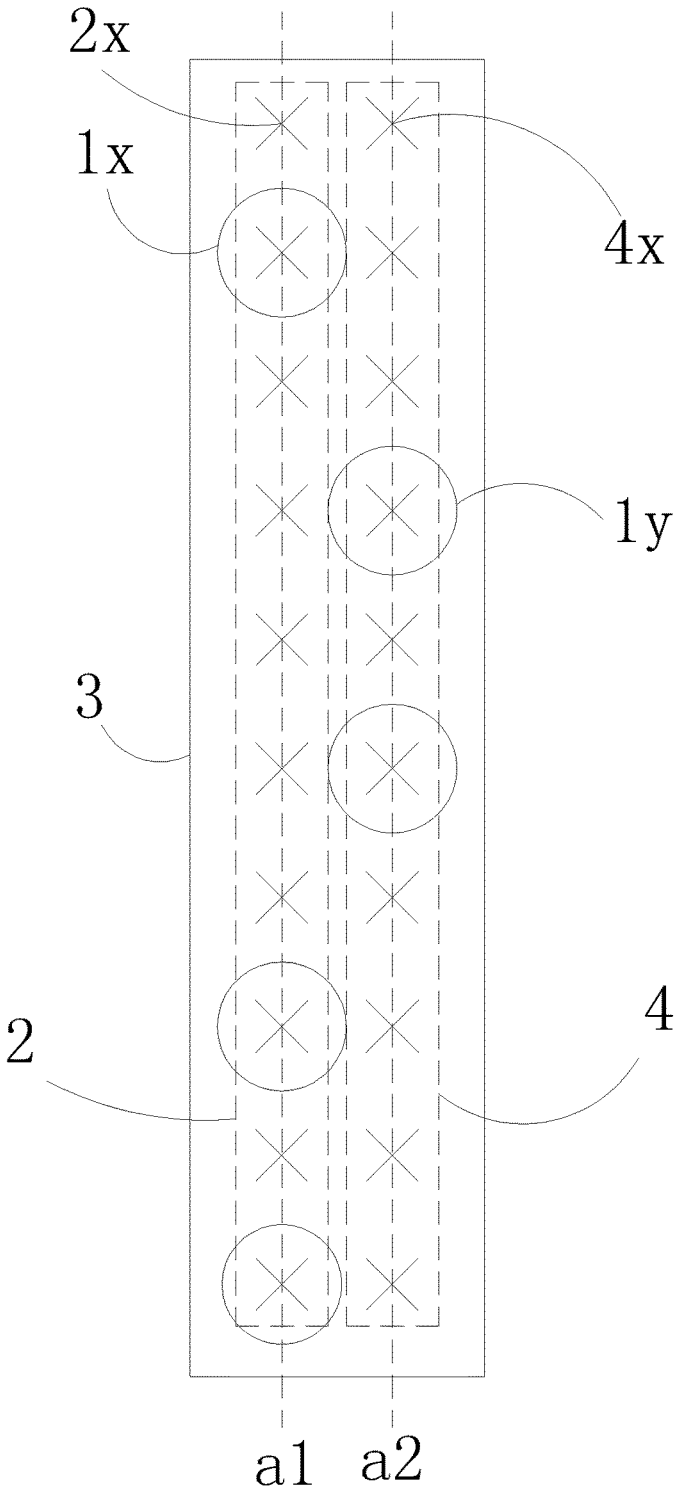
FIG. 9 shows a structural view of a fourth embodiment of a multi-frequency shared antenna according to the invention which is suitable to be used in application where signals of two or three frequencies are transmitted.

Please refer to FIG. 9. A fourth embodiment of a multi-frequency shared antenna of the present invention is made upon prior art technique shown in FIG. 5. The difference between this embodiment and the third embodiment lies in the pitch between low frequency radiation units is integer times as great as the pitch between high frequency radiation units. In the third embodiment, the pitch between low frequency radiation units is not integer times as great as the pitch between high frequency radiation units. In this fourth embodiment, along a direction orthogonal to axes a1 and a2 (lateral direction in this figure) of the high frequency radiation arrays 2 and 4, the first and second high frequency radiation units 2$x$ and 4$x$ are aligned with each other, thus regularly forming two columns of matrices. Differently in this embodiment, each of the first and second high frequency radiation arrays 2 and 4 only includes 10 high frequency radiation units 2$x$ and 4$x$, while the low frequency radiation array 1 still maintains its 5 low frequency radiation units 1$x$, 1$y$. Accordingly, the pitch between two adjacent low frequency radiation units arranged on each axis is still integer times as great as the pitch between two adjacent high frequency radiation units 2$x$, 4$x$ of each of the high frequency radiation arrays 2 and 4. In this case, on the first axis a1 on which the low frequency radiation array 1 is located (that is, the axis on which the first high frequency radiation array 2 locates), 3 low frequency radiation units 1$x$ are provided, while on the second axis a2 on which the low frequency radiation array 1 is located (that is, the axis on which the second high frequency radiation array 4 locates), 2 low frequency radiation units 1$y$ are provided. Each of the low frequency radiation units 1$x$ and 1$y$ are nested with a corresponding high frequency radiation in the aforementioned manner. Along axial direction of the axes a1 and a2, there is just a location for one high frequency radiation unit between two low frequency radiation units. In other words, a low frequency radiation unit nested with another high frequency radiation unit adjacent to a first high frequency radiation unit is provided. 3 low frequency radiation units 1$x$ is arranged on the first axis a1 at locations 1, 4 and 5 in order, while 2 adjacent low frequency radiation units 1$y$ is arranged on the second axis a2 at locations 2 and 3 in order. The Multi-frequency shared antenna realized in this embodiment may also realize normal signal operation at 3 frequency bands. This ensures that antenna size is minimized and also ensures that interference among radiation arrays working at different frequency bands is mostly reduced.

Figure 10:
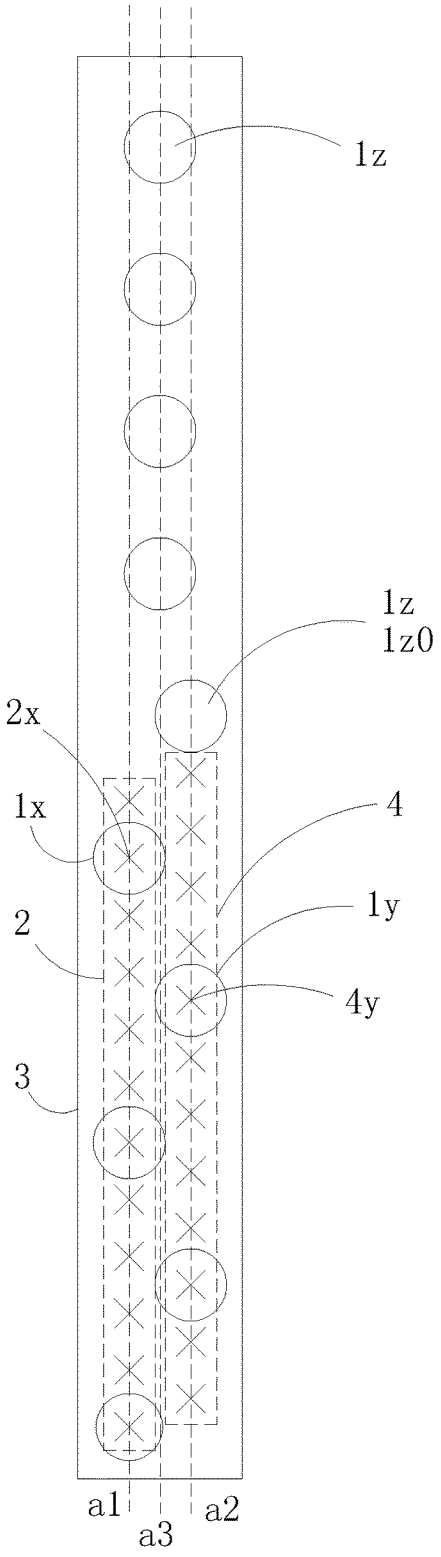
FIG. 10 shows a structural view of a fifth embodiment of a multi-frequency shared antenna according to the invention which is suitable to be used in application where signals of two or three frequencies are transmitted.

Please refer to FIG. 10. The fifth embodiment of the multi-frequency shared antenna of the invention is made upon the third embodiment. In this embodiment of the multi-frequency shared antenna, a number of low frequency radiation units 1$z$ of the low frequency radiation array 1 are added on an extending direction of the respective axes a1 and a2. As denoted by FIG. 10, 5 low frequency radiation units 1$z$ are disposed above the first and second high frequency radiation arrays 2 and 4. 4 of these low frequency radiation units 1$z$ are located on a third axis a3 which is just a symmetrical axis of the first axis a1 and second axis a2 of the low frequency radiation array 1 as stated in the third embodiment. The third axis a3 is also the symmetrical axis of the axes of the first and second high frequency radiation arrays 2 and 4. The rest one of the 5 low frequency radiation units 1$z$ is directly positioned on the axis a2 of the second high frequency radiation array 4 (it is also the second axis a2 of the low frequency radiation array 1). Alternatively speaking, 3 low frequency radiation units are arranged on the second axis a2 of the low frequency radiation array 1. In addition, 2 low frequency radiation units 1$y$ fall within axis range occupied by 4 high frequency radiation units 4$y$ of the second high frequency radiation array 4, and are nested with these high frequency radiation units by the manner described in aforementioned embodiments. The rest one low frequency radiation unit is located outside of the second high frequency radiation array 4. Of course, pitch between each two adjacent low frequency radiation units along the axes a1 and a2 is identical. Apparently, this embodiment may also obtain technical effects obtained by preceding embodiments.

Figure 11:
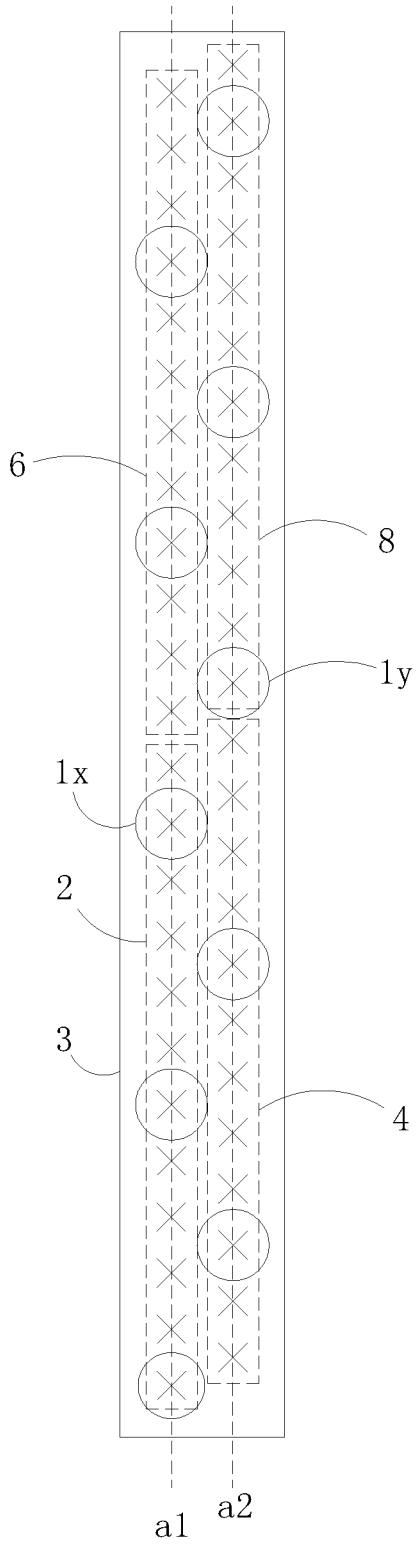
FIG. 11 shows a structural view of a sixth embodiment of a multi-frequency shared antenna according to the invention which is suitable to be used in application where signals of two through five frequencies are transmitted.

Please refer to FIG. 11. A sixth embodiment of a multi-frequency shared antenna of the invention discloses a five-frequency shared antenna made upon the third embodiment. In other words, in addition to the first and second high frequency radiation arrays 2 and 4, this kind of multi-frequency shared antenna further comprises a third and fourth high frequency radiation arrays 6 and 8 powered by separate two feeding networks respectively. The axis a1 of the third high frequency radiation array 6 overlaps the extension line of the axis a1 of the first high frequency radiation array 2, whilst the axis a2 of the fourth high frequency radiation array 2 overlaps the extension line of the axis a2 of the second high frequency radiation array 2. Partial low frequency radiation units 1*x* and 1*y* of the low frequency radiation array 1 are located on the extension lines of the first and second axes a1 and a2 respectively. Therefore, the total number of the low frequency radiation units 1*x* and 1*y* of the low frequency radiation array 1 is increased to 10 and these low frequency radiation units constitute an array and are powered by a same feeding network. Considering number and location relationship of the low frequency radiation units 1*x* distributed on the first axis a1 and resultant electrical relationship, when the number of the low frequency radiation units 1*x* within the axis range occupied by the first high frequency radiation array 2 is 3, the number of the low frequency radiation units 1*x* within the axis range occupied by the third high frequency radiation array 6 will be 2. Similarly, when the number of the low frequency radiation units 1*y* within the axis range occupied by the second high frequency radiation array 4 is 2, the number of the low frequency radiation units 1*y* within the axis range occupied by the fourth high frequency radiation array 8 will be 3. By this manner, it is ensured that 5 low frequency radiation units 1*x* and 1*y* will be provided on the first and second axes a1 and a2 of the low frequency radiation array 1 respectively and these low frequency radiation units are misaligned with each other as described at the beginning. Each low frequency radiation array 1 is nested with 4 high frequency radiation arrays 2, 4, 6 and 8 and all these arrays are mounted on the same reflection plate 3. As a result, the antenna size is significantly reduced and electric performance is still good.

Figure 12:
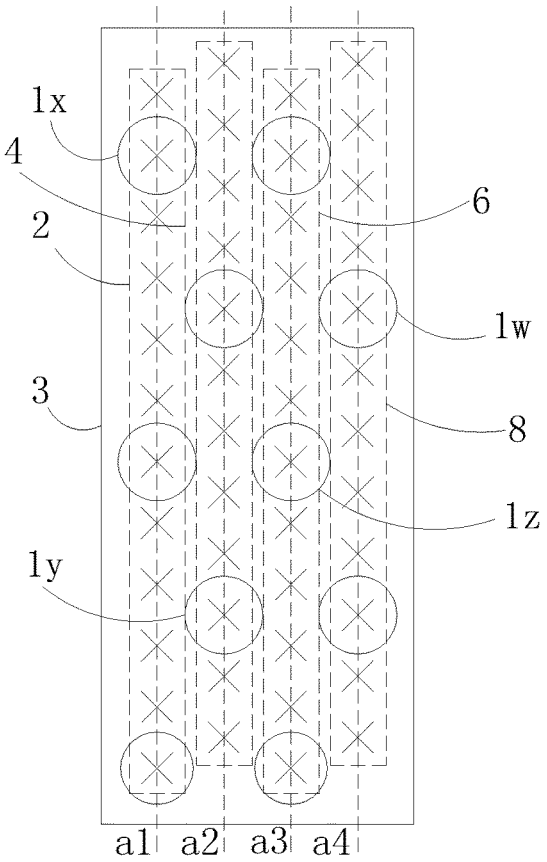
FIG. 12 shows a structural view of a seventh embodiment of a multi-frequency shared antenna according to the invention which is suitable to be used in application where signals of two through six frequencies are transmitted.

Please refer to FIG. 12. A seventh embodiment of a multi-frequency shared antenna of the invention discloses a six-frequency shared antenna based on the third embodiment. However, this embodiment is different from the third embodiment in their layout. In the seventh embodiment, it is formed with side by side arrangement of the antennae illustrated in the third embodiment. Specifically, it includes a third and fourth high frequency radiation arrays 6 and 8 parallel to the first and second high frequency radiation arrays 2 and 4 and powered separately by other feeding networks. In addition, it also includes two low frequency radiation arrays. Here, the low frequency radiation units 1*x*, 1*y*, 1*z* and 1*w* are distributed on at least four axes a1, a2, a3 and a4 overlapping the axes a1, a2, a3 and a4 of the second high frequency radiation array 2 respectively. The low frequency radiation units 1*x* and 1*y* form a low frequency radiation array working at an independent frequency band and are powered by a separate feeding network. The low frequency radiation units 1*z* and 1*w* form another low frequency radiation array working at an independent frequency band and are powered by another feeding network. Similarly, this embodiment may also realize small antenna size and get better electric performance.

It is established from above various embodiments of the invention that for the multi-frequency shared antenna, multiple low frequency radiation units of the low frequency radiation array 1 are distributed on different axes, thus reducing signal interference between the low frequency radiation array 1 and high frequency radiation array 2 and maintaining entire size of the antenna minimized.

The multi-frequency shared antenna of the invention may find its application in an antenna control system. In this situation, multiple high frequency radiation arrays 2 and low frequency radiation arrays 1 are powered by different feeding networks. Each feeding network contains a phase shifter including first and second components. Sliding of the first component relative to the second component results in phase change of signal passing through the phase shifter, thereby changing phase of the signal provided to corresponding radiation unit and resulting in tilting of the antenna beam. To this end, driving force is supplied to the first component of the phase shifter so as to realize remote control of the antenna beam tilting.

A well-known method is provision of complex driving construction inside the antenna. This, however, leads to size and weight increase of the antenna. To maintain small size, in the present invention, the antenna control system is provided with a removable electromechanical driving component. The electromechanical driving component includes a power control unit, a motor and a mechanical driving unit. In response to an external control signal, the power control unit drives the motor to produce a predefined motion. Through the torque generated by the mechanical driving unit, the predefined motion of the motor is applied to the first component so as to realize phase shifting. Accordingly, when it is desired to tilt beam, the electromechanical driving component may be installed in the multi-frequency shared antenna and the mechanical driving unit thereof may act on the first component of the phase shift, thus achieving beam down-tilting adjustment by external signal control. When the desired beam tilting angle is met, the electromechanical driving component may be turned off therefrom such that respective phase shifters of each feeding networks are maintained phase stationary. By this manner, beam tilting angle of the multi-frequency shared antenna is constant.

It is noted that an axis as used herein means a hypothetical line segment. In addition, overlapping between the axes also permits slight deviation as known by person of skill in the art. For example, when a high frequency radiation unit is added onto a piece of low frequency radiation unit, an axis may be bias a slight distance from the another axis. As described in the embodiment shown in FIG. 6, the axis of the high frequency radiation array may also be biased a distance from the axis of the low frequency radiation array if the low frequency radiation units are designed to be of bowl-shaped balun. Accordingly, slight deviation between two axes is also within the meaning of the term "overlapping" as defined in this invention. Moreover, the same reasoning also applies to the term "concentric".

Furthermore, in most cases, the low frequency radiation unit may be a symmetric dipole which has an orthogonal projection shape on the reflection plate of diamond, rectangular, polygon or multiple segments. It may also be a surface mounted dipole or flatly printed radiation unit. The high frequency radiation unit may be dipole disclosed in U.S. Pat. No. 6,933,906B2 to Kathrein, Chinese Patent No.: CN2702458Y to Comba Company or U.S. Pat. No. 7,053,852B2 to Adrew or other type of dipole.

Furthermore, it is emphasized that preferably the biggest diameter of the low frequency radiation unit is smaller than 150 mm so as to further reduce size of the antenna and ensure good electric performance.

Figure 13:
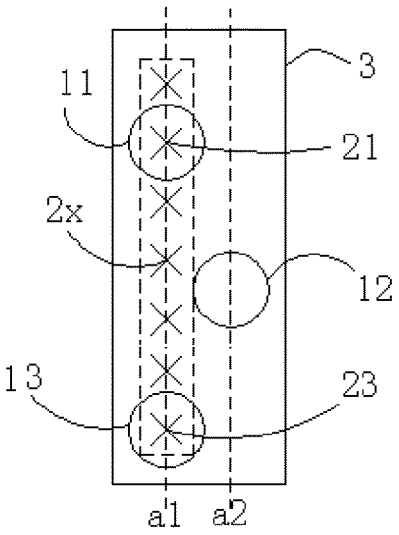
FIG. 13 shows a structural view of a eighth embodiment of a multi-frequency shared antenna according to the invention which is suitable to be used in application where signals of two frequencies are transmitted.

Referring to FIG. 13, an embodiment of the invention also provides a multi-frequency antenna including a reflection plate 3, a first frequency radiation array 2*x* (including 21 and 23) and a second frequency radiation array (11, 12 and 13). The first frequency is higher than the second frequency. The second frequency radiation array (11, 12 and 13) has a first axis a1 and a second axis a2 substantially parallel in a vertical direction to the first axis a1. It is understood that the axes a1 and a2 are hypothetical to further illustrate relationship between the first frequency radiation array and second frequency radiation array on the reflection plate 3.

The second frequency radiation array includes at least three second frequency radiation units (11, 12 and 13) located on the first and second axes a1 and a2 respectively. At least one second frequency radiation unit is provided on each axis. The three second frequency radiation units (11, 12 and 13) are misaligned among each other in a direction orthogonal to the axial direction. Preferably, three second frequency radiation units (11, 12 and 13) have the same or similar distance among each other in a direction orthogonal to the axial direction.

The first frequency radiation array includes at least one first frequency radiation unit 21 located on the first axis a1.

The second frequency radiation units (11 and 13) on the first axis a1 are nested with partial first frequency radiation units (21 and 23) on the first axis a1. Reference is made to U.S. Pat. No. 4,434,425 to GTE, U.S. Pat. No. 6,333,720 to Kathrein and Chinese Patent No.: 200710031144.3 to Comba Company. Clearly, it is well known in the art to use two different frequency radiation units in nesting manner. Preferably, in embodiments of the invention, the nesting may be realized as follows: the orthogonal projection area of the first frequency radiation unit on the reflection plate falls within the orthogonal projection area of the second frequency radiation unit on the same plate. Therefore, in a nested multiple-frequency antenna, by misaligning the second frequency radiation units (11, 12 and 13) along a direction orthogonal to the axial direction, size of the antenna is further reduced. Consequently, the antenna has reasonable size and better electric performance as well.

In this embodiment, preferably each second frequency radiation unit includes two polarization elements each of which includes two radiation arms. Said two radiation arms may be provided with different power. Further, each radiation arm is a symmetrical dipole. Each polarization element of the second frequency radiation unit has a pair of symmetrical dipoles which can be supplied with different feed-in power. Using different feed-in power, the horizontal plane half power beam width of the second frequency radiation array is regulated. The symmetrical dipoles described in this embodiment may be those disclosed in U.S. Pat. No. 4,434,425, 6,333,720, or Chinese Patent 200710031144.3.

In this embodiment, preferably, the first frequency radiation array 2*x* (including 21 and 23) and second frequency radiation array (11, 12 and 13) positioned on the reflection plate 3 are powered by different feeding networks. The pitch between the first and second axes is smaller than or equal to the biggest orthogonal projection size of a single second frequency radiation unit arranged on one of two axes. It is understood that the biggest orthogonal projection size means the longest distance between two sides of the projection perimeter of the radiation unit projected onto the reflection plate. For a circle projection shape, the biggest orthogonal projection size is the diameter of the circle; and for a square projection, the biggest orthogonal projection size is the length of the diagonal line. It is also understandable that for other regular or irregular projection shape, the biggest orthogonal projection size is the smallest diameter of a circle which encircles the irregular projection shape. Therefore, the present invention is adapted to specific used frequency requirement.

In this embodiment, preferably a symmetrical axis a3 is defined between the first and second axes. Two low frequency radiation units of all the second frequency radiation units positioned on different axes form a group. Regarding four symmetrical dipoles of the same polarization in the group, symmetrical dipoles close to the symmetrical axis a3 have the same or similar feed-in power, and those away from the symmetrical axis a3 also have the same or similar feed-in power. In addition, feed-in power of those dipoles close to the symmetrical axis a3 is greater than that of the dipoles away from the symmetrical axis a3. By above setting, the horizontal plane half power beam width of the second frequency radiation array is further widened, and left and right symmetry of the horizontal direction pattern is also guaranteed.

In this embodiment, preferably nesting use of the second frequency radiation unit on the first axis and partial first frequency radiation units on the same axis is as follows: the second frequency radiation has its geometrical center overlapped that of at least one first frequency radiation unit.

In this embodiment, preferably nesting use of the second frequency radiation unit on the first axis and partial first frequency radiation units on the same axis is as follows: the orthogonal projection area of the high frequency radiation unit on the reflection plate falls within that of the low frequency radiation unit on the same plate.

In this embodiment, preferably in the multi-frequency shared antenna provided by embodiments of the invention, the second frequency radiation array also includes a third axis running as a symmetrical axis of the first and second axes. The second low frequency radiation units are located on this symmetrical axis.

In a summary, by making improvement on layout of the multi-frequency shared antenna, the antenna is benefited from reasonable size, and better electric performance. Further, relationship between linear arrangement pitch of the low frequency radiation units and that of the high frequency radiation units is no longer a critical factor having heavy influence on design of antenna layout by person of skill in the art.

The antenna size is more reasonable because of the following reasons.

In case that pitch among low frequency radiation units arranged on the same axis is not integer times as great as that of the high frequency radiation units, by placing different low frequency radiation units of the same low frequency radiation array on two or more axes, interference (overlapping or crossing) among low frequency radiation array and high frequency radiation array in the orthogonal projection area is avoided, thus signal transmission of the low and high frequency radiation arrays will not interfere with each other, thereby eliminating or reducing mutual interference.

In case that pitch among low frequency radiation units arranged on the same axis is integer times as great as that of the high frequency radiation units, for example in case where three frequencies present and at least two of them are identical high frequency arrays, compared to solution in which a group of high frequency radiation arrays is added in a vertical direction of the antenna, use of the present invention not only avoids increase of transfer loss caused by lengthening of the main feeder line of the upper high frequency radiation arrays, but also obtain increase of antenna gain. Moreover, when the length of the low frequency radiation array is smaller than integer times of the length of the high frequency radiation array, the entire length of the antenna is dramatically decreased. Compared to adjoining technical solution, use of the invention also reduces width of the antenna. Further, as the low frequency radiation units are arranged in a misaligned manner in a direction orthogonal to the axis, symmetry between left and right radiation boundary of the low and high frequency radiation arrays is improved. Antenna design difficulty is also reduced.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

The invention claimed is:

1. A multi-frequency shared antenna, comprising a low frequency radiation array and a first high frequency radiation array both of which are disposed on a reflection plate, wherein, the low frequency radiation array comprises a plurality of low frequency radiation units axially arranged on at least two parallel axes, and said low frequency radiation units on said two axes are misaligned along a direction orthogonal to these axes;

the pitch between said two axes of the low frequency radiation array is smaller than or equal to a half wavelength of the low frequency radiation array at its highest working frequency point, and it is also greater than or equal to a half wavelength of the high frequency radiation array at its highest working frequency point;

each low frequency radiation unit comprises two pairs of symmetrical dipoles arranged such that their polarization is orthogonal to each other, and two symmetrical dipoles of one pair of symmetrical dipoles of at least one low frequency radiation unit of the low frequency radiation array have different feed-in power settings;

the first high frequency radiation array comprises a plurality of high frequency radiation units, at least some of the high frequency radiation units are arranged on an axis which overlaps one of said two parallel axes of the low frequency radiation array, in all high frequency radiation units arranged on said axis which overlaps one of said two parallel axes, at least one high frequency radiation units is nested with a corresponding low frequency radiation unit and an orthogonal projection area of each of the at least one nested high frequency radiation unit on the reflection plate falls within the orthogonal projection area of each corresponding low frequency radiation unit on the same reflection plate.

2. The multi-frequency shared antenna according to claim 1, wherein for said at least two parallel axes, any two adjacent low frequency radiation units arranged on different axes form a group, in four symmetrical dipoles with the same polarization of the group, a symmetrical axis is defined between a first axis and a second axis, symmetrical dipoles close to said symmetrical axis have the same or substantially same feed-in power, symmetrical dipoles away from said symmetrical axis have the same or substantially same feed-in power, and the feed-in power of the dipoles close to the symmetrical axis is greater than that of the dipoles away from the symmetrical axis.

3. The multi-frequency shared antenna according to claim 1, wherein a symmetrical axis is defined between a first and second axes of said at least two parallel axes, the sum of feed-in power of the adjacent symmetrical dipoles located at left of the symmetrical axis is identical to or substantially identical to that of the adjacent symmetrical dipoles located at right of the symmetrical axis, the sum of feed-in power of the symmetrical dipoles located at left of the symmetrical axis and distanced away from each other is identical to or substantially identical to that of the symmetrical dipoles located at right of the symmetrical axis and distanced away from each other, and the sum of the former is larger than that of the latter.

4. The multi-frequency shared antenna according to claim 1, further comprising a second high frequency radiation array, the second high frequency radiation array comprises a plurality of high frequency radiation units which are at least partially arranged on a same axis, and the axis of the first high frequency radiation array is adjacent and parallel to the axis of the second high frequency radiation array.

5. The multi-frequency shared antenna according to claim 4, wherein the axis of the second high frequency radiation array overlaps one axis of the low frequency radiation array, at least one of said high frequency radiation units of the second high frequency radiation array is nested with a corresponding low frequency radiation unit, and an orthogonal projection area of each of the at least one nested high frequency radiation unit on the reflection plate falls within the orthogonal projection area of each corresponding low frequency radiation unit on the same plate.

6. The multi-frequency shared antenna according to claim 5, wherein at one end of the symmetrical axis of the axes of the first and second high frequency radiation arrays, the plurality of low frequency radiation units of the low frequency radiation array are distributed along said symmetrical axis.

7. The multi-frequency shared antenna according to claim 5, further comprising a third and fourth high frequency radiation arrays located parallel to each other, an axis of the third high frequency radiation array overlaps an extension line of the axis of the first high frequency radiation array, and an axis of the fourth high frequency radiation array overlaps an extension line of the axis of the second high frequency radiation array, in the ranges of the extension lines where the third and fourth high frequency radiation arrays are located, there are low frequency radiation units for nesting with the third and fourth high frequency radiation arrays, the orthogonal projection area of the nested high frequency radiation units on the reflection plate falls within the orthogonal projection area of corresponding low frequency radiation units on the same plate.

8. The multi-frequency shared antenna according to claim 5, further comprising third and fourth high frequency radiation arrays parallel to the first and second high frequency radiation arrays, respectively, and a second low frequency radiation array, the second low frequency radiation array is assembled with the third and fourth high frequency radiation arrays and an axis thus formed is parallel to the aforementioned axes.

9. The multi-frequency shared antenna according to claim 1, wherein some of the high frequency radiation units of the first high frequency radiation array are arranged along a third axis; and the high frequency radiation units of the first high frequency radiation array arranged on respective axes are misaligned among each other along a direction orthogonal to the axes.

10. The multi-frequency shared antenna according to claim 1, wherein both the low frequency radiation array and the first high frequency radiation array are distributed on two axes, one axis of the low frequency radiation array overlaps one axis of the first high frequency radiation array, and another axis of the low frequency radiation array and another axis of the first high frequency radiation array are symmetrical about the overlapped axis.

11. The multi-frequency shared antenna according to claim 1, wherein there is no interference between an orthogonal projection on the reflection plate of a radiation arm of a symmetrical dipole of any low frequency radiation unit and that of a symmetrical dipole of any high frequency radiation unit.

12. The multi-frequency shared antenna according to claim 1, wherein along an orthogonal projecting direction towards the reflection plate, the pitch between two adjacent axes of the low frequency radiation array is smaller than or equal to the biggest orthogonal projection size of an individual low frequency radiation unit arranged on these axes.

13. The multi-frequency shared antenna according to claim 1, wherein along the axial direction of the low frequency radiation array, some low frequency radiation units with odd locations are arranged on an axis of the low frequency radiation array, while some low frequency radiation units with even locations are arranged on another axis thereof.

14. The multi-frequency shared antenna according to claim 1, wherein along the axial direction of the low frequency radiation array, some low frequency radiation units with discrete locations are arranged on an axis of the low frequency radiation array, while some low frequency radiation units with continuous locations are arranged on another axis thereof.

15. The multi-frequency shared antenna according to claim 1, wherein the high frequency radiation units and/or low frequency radiation units are of printed planar radiation unit or surface mounted dipole.

16. The multi-frequency shared antenna according to claim 1, wherein the biggest diameter of the low frequency radiation unit is smaller than 150 mm.

17. A multi-frequency shared antenna, comprising a reflection plate, a first frequency radiation array and a second frequency radiation array, wherein, the first frequency is higher than the second frequency, the second frequency radiation array has a first axis and a second axis substantially parallel in a vertical direction to the first axis;

the second frequency radiation array comprise at least three second frequency radiation units located on the first and second axes, at least one of the second frequency radiation units is provided on each axis, three second frequency radiation units are misaligned among each other in a direction orthogonal to the axial direction;

the first frequency radiation array comprise at least one first frequency radiation unit located on the first axis.

* * * * *